United States Patent [19]

King

[11] Patent Number: 5,018,691

[45] Date of Patent: May 28, 1991

[54] SUPPORT RACK

[76] Inventor: Bradley W. King, 145-215 Mississauga Valley Blvd., Mississauga, Ontario L5A 1Y7, Canada

[21] Appl. No.: 498,913

[22] Filed: Mar. 26, 1990

[51] Int. Cl.[5] ..... B65B 67/04

[52] U.S. Cl. ..... 248/99; 248/97

[58] Field of Search ..... 248/95, 97, 99, 146; 220/401, 404

[56] References Cited

U.S. PATENT DOCUMENTS

| | | | |
|---|---|---|---|
| 996,421 | 6/1911 | McCausland | 248/99 |
| 3,420,483 | 1/1969 | Stalker | 248/95 |
| 3,861,125 | 1/1975 | Hagemeister | 248/99 X |
| 4,623,111 | 11/1986 | Prader | 248/97 |
| 4,750,694 | 6/1988 | Bateman | 248/99 X |
| 4,840,335 | 6/1989 | Forman, Jr. et al. | 248/99 X |

*Primary Examiner*—Gary L. Smith
*Assistant Examiner*—Michael J. Milano
*Attorney, Agent, or Firm*—Donald E. Hewson

[57] ABSTRACT

A support rack used for holding plastic bags used for receiving and retaining household refuse is disclosed. Such a rack comprises a frame, preferably of an open nature, and a pair of arms connected to the frame near the top. The arms are used to each support one handle of a plastic bag and are spaced apart relative to one another such that the plastic bag is held open. The frame is preferably open at one side thus allowing for easy depositing and removal of plastic bags. One of the handles is adapted to neatly store an inventory of plastic bags thereon, thus keeping the inventoried bags readily acessible. The inventoried bags are held neatly and out of the way by a spring biased arm.

11 Claims, 2 Drawing Sheets

SUPPORT RACK

FIELD OF THE INVENTION

This invention relates to household refuse containers typically used in a kitchen or workshop and more particularly to such containers that use plastic shopping bags for receiving and retaining refuse.

BACKGROUND OF THE INVENTION

Household refuse containers come in a variety of shapes and sizes and typically are used in conjunction with a bag, generally plastic or paper, to contain refuse. Use of such a bag precludes the refuse container from coming in contact with the refuse and becoming soiled. Such a bag also makes the subsequent disposal of the refuse much easier, quicker, and cleaner. Many household refuse containers are merely metal or plastic "garbage cans" that typically sit on a floor or inside a cupboard, and a paper or plastic bag is placed therein. The bag may be turned over at the top to preclude the bag from falling down inside the garbage can, and generally to keep the bag open.

Some refuse containers typically found in kitchens, are designed to be attached to a cupboard door such that when the cupboard is opened the refuse container is very accessible, and yet is hidden from view when the cupboard door is closed. Within the last twenty years, plastic shopping bags have become extremely popular, or actually quite common place. Typically, plastic shopping bags have a pair of handles at the top of the bag, one on each side, as an integral part of the bag. This has helped to change the style of refuse containers that are commonly used in kitchens today. Because plastic garbage bags can fit tightly around a lip of a refuse container and do not require the same support from the container that a paper bag would require, it is possible to have a refuse container that is merely a skeleton frame instead of having full sides and a full bottom. This is desirable because it allows such a container to be made from a lesser amount of material and therefore made less expensively. Additionally, since these plastic bags typically have a pair of carrying handles, it is possible to suspend the bag by these handles, and use the bag for receiving and retaining refuse.

One common problem associated with the use of plastic bags for receiving and retaining refuse as described herein, is the actual storing of the plastic bags. Typically, the plastic bags are folded and placed into a drawer where they may be kept reasonably neatly. Alternatively, they may be thrown into a cupboard where they may be kept neatly but more often than not will become piled in a disorganized manner. In any case, the bags are not kept with the refuse container and therefore must be searched out and found every time another bag is required for the refuse container. Also, depending on the state of disorganization of the bags whether they be in a drawer or piled in a cupboard, it may be inconvenient or even difficult to pick out one bag from a clump of several bags. It would be highly desirable to keep the bags with the container in a neat and orderly manner, such that they are readily accessible and easy to use.

Another problem with many types of refuse containers that use plastic bags for receiving and retaining refuse is that they support the plastic bag around the top rim with the bag folded over the rim. This keeps the bag open for receiving the refuse. However, any bag used must be approximately of a certain circumference, else it will either not fit onto the container or it will fit too loosely and therefore be prone to slipping off. One way to allow almost any circumference of two handled plastic bag to be used is to suspend the bag completely or at least substantially by the two handles. This may cause the bag to remain in a slighly less that fully opened state, but it would remain open enough such as that refuse can be easily deposited.

DESCRIPTION OF THE PRIOR ART

A very common form of refuse container used to receive and retain household refuse in plastic bags is a wire frame arrangement that is adapted to hold a plastic bag having no handles. The top of the plastic bag is folded over a rim and is held snugly in place by the rim, which is substantially the same circumference as the plastic bag. It is also possible to use plastic bags having handles with this type of container, but it does not allow the full size of the big to be used since the handles are folded down over the rim. Furthermore, it does not properly accommodate different sizes of bags nor does it store a supply of bags.

Another form of container is one that is adapted to hold plastic bags by the handles, and also is adapted to open and close at the top such that the plastic bag also opens and closes at its opening. In order to keep the plastic bag reasonably sealed when closed, a relatively substantial area of the bag around each handle is captured by the container. This makes it difficult to open the bag to its full size when something is to be put in.

SUMMARY OF THE INVENTION

The present invention provides means for retaining a plastic bag in an open position such that it is ready to receive and retain refuse, such bag being supported by its handles. Furthermore, the present invention provides a storage space for the storage of an inventory of plastic bags to be used subsequently, with the inventory of plastic bags being held out of the way and in an orderly manner by a spring biased arm. Such features are also provided in one integral unit, which makes it quite easy to inventory the bags in a neat and tidy manner and to take bags one at a time from the inventory bags and place them in an open position ready to receive and retain refuse.

BRIEF DESCRIPTION OF THE DRAWINGS

Embodiments of this invention will now be described by way of example in association with the accompanying drawings, in which.

DETAILED DESCRIPTION OF THE PREFERRED EMBODIMENTS

Figure 1:
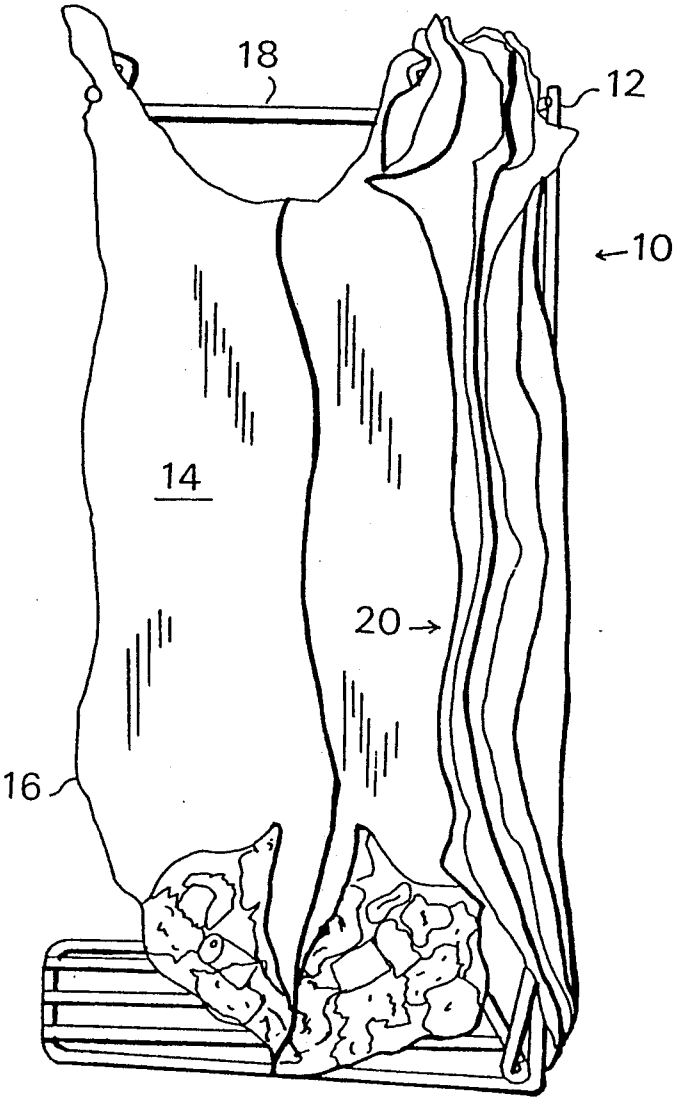
FIG. 1 is a side view of the support rack mounted and ready for use, with bags both stored and ready for use.

Reference will now be made to FIG. 1 in which the support rack 10 is securely attached to a vertical surface 12, which is typically a cupboard door. The plastic bag 14 containing refuse 16 is presently the bag in use, and is in place on the bag support member 18 and hanging therefrom such that the bag is ready to receive and retain refuse 16.

An inventory of plastic bags 20 is stored on one side of the support rack 10, preferably toward the rear, so as not to interfere with plastic bag 14, that is in place on bag support member 18.

Figure 2:
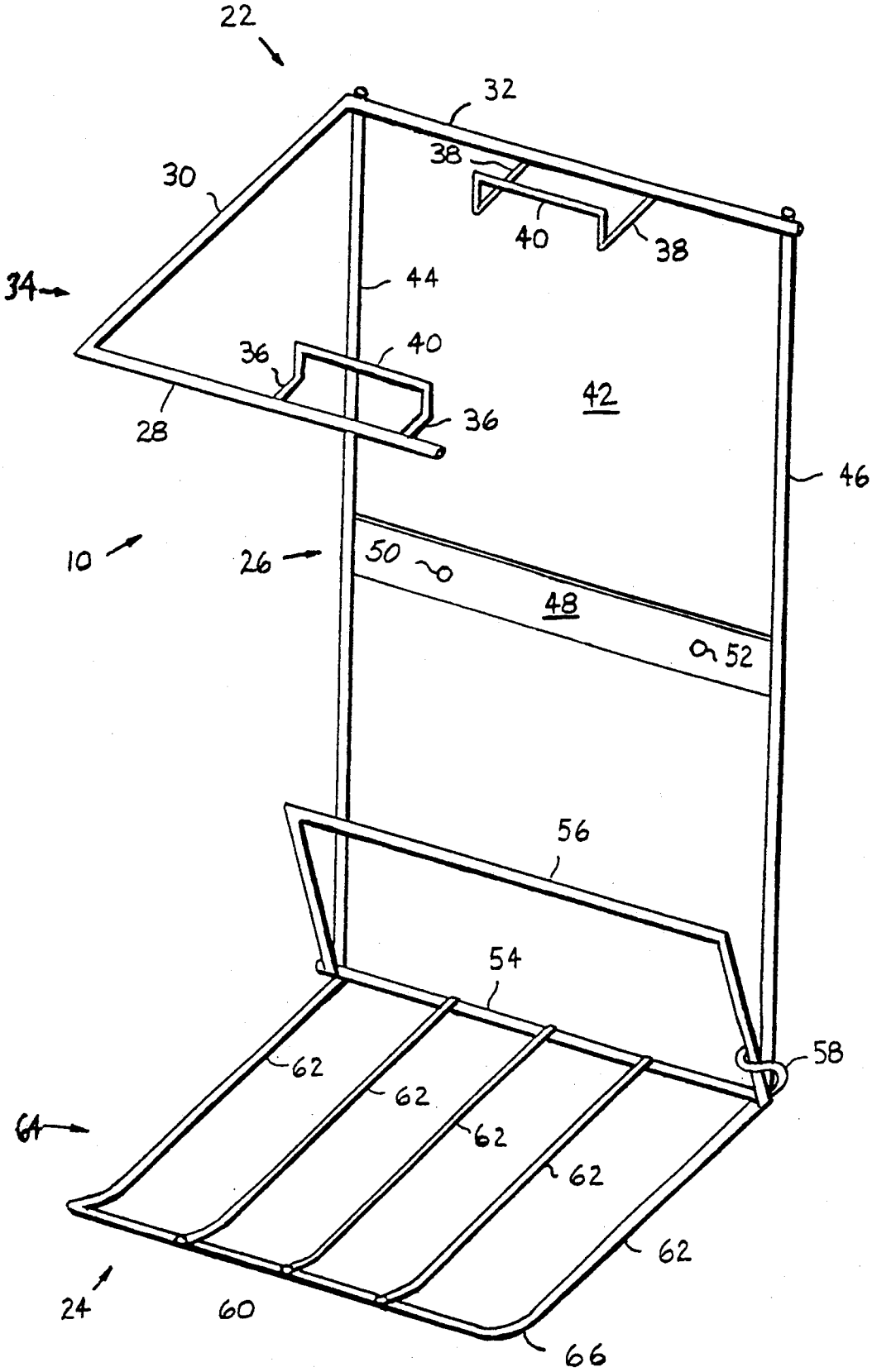
FIG. 2 is a perspective view of the same support rack.

Reference is now made to FIG. 2 which shows the support rack 10 not in use, having the first horizontal portion 22, a second horizontal portion 24, and a vertical portion 26. First horizontal portion 22 comprises front frame member 28, side frame member 30 and rear frame member 32 which securely connected together to form bag support member 34. Located on the rear side of front frame member 28 is first arm means 36, which is used to receive and retain one arm of a plastic bag. Similarly, on the front side of rear frame member 32 is second arm means 38. Each of said arm means 36 and 38 have associated therewith a stop means 40 that precludes the handles of a bag in place on said arm means 36, 38 from being removed off said arm means 36, 38 by moving the bag handles strictly in a horizontal direction. In order to remove the bag, or a bag, from first and second arm means 36, 38 it is necessary to lift each handle over the stop means 40 of the associated first or second arm means 36, 38, and then move each handle horizontally toward the centre of the support rack.

The bag support member 34 is roughly in the shape of a letter "U", thereby leaving an open side 42 for easy depositing and removal of a plastic bag onto or off the first or second arm means 36, 38.

Extending generally downwardly beneath the rear frame member 32 of bag support member 34 is a pair of vertical members 44, 46. It is also possible to have a single vertical member which would depend from around the centre of the rear frame member 32. These vertical members 44, 46 are part of the vertical portion 26 of support rack 10, and extend to the bottom of the support rack 10. Spanning between vertical member 44 and vertical member 46 is an attachment means 48, which is typically a thin but sturdy metal plate. Attachments means 48 has a plurality of receiving holes 50, 52 therein for threadably attaching the support rack 10 to a horizontal surface, typically a cupboard door or possibly a wall, as mentioned earlier.

Vertical portion 26 of support rack 10 terminates at its bottom end in a connecting member 54 that rigidly connects vertical members 44, 46 to one another. Clip arm means 56 is attached pivotally to connecting member 54 and is biased by spring means 58 such that is urged rearwardly toward vertical members 44, 46 of vertical portion 26. Clip arm means 56 is shown in an opened position, such that it is ready to receive the bottom portion of any inventoried plastic bags. The clip arm means 56 is used to keep the bottom portions of any inventoried plastic bags that are hanging from second arm means 38 neatly together and out of the way. This precludes the inventoried bags from interfering with a bag in use, such bag having one handle hanging from said first arm means 36 and one handle hanging from second arm means 38, and possibly containing refuse.

Second horizontal portion 24 comprises an end member 60 that is generally parallel to vertical portion 26 and is displaced therefrom by about the same distance as front frame member 28 and rear frame member 32 are spaced apart. A plurality of spanning arms 62 span between connecting member 54 and end member 60. Together, end member 60 and spanning arms 62 form a support means 64 for supporting the bottom area of a plastic bag that is in place on said first and second arm means.

In the preferred embodiment, support means 64 includes an upturned lip 66 such that end member 60 is raised above the level of spanning arms 62. Said upturned lip 66 precludes outward horizontal displacement past the lip of the bottom portion of a plastic bag, typically containing refuse, when said plastic bag in place on the first arm means 36 and second arm means 38.

Figure 3:
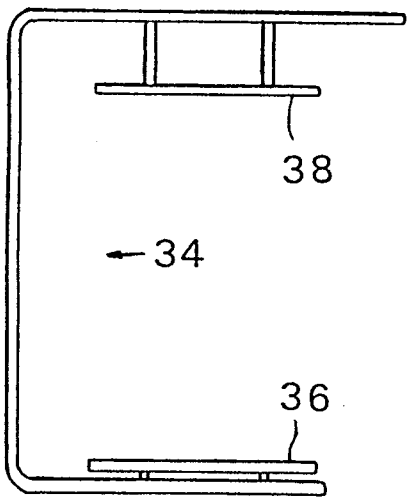
FIG. 3 is a top view of the same support rack with some details omitted for clarity.

Reference is now made to FIG. 3 that clearly shows the bag support member 34 and first arm means 36 and second arm means 38. Second arm means 38 is shown to be substantially longer than first arm means 36. Second arm means 38 is thereby adapted to accommodate a plurality of plastic bags in an inventory, to be used at some future time.

In an alternative embodiment, a suitable lid is contemplated that would allow the top area of the refuse container to be covered as desired. Such a lid could include a fairly conventional plastic type of lid that it is pivotably attached by a hinge. Alternatively, a lid that is made from some sort of soft pliable plastic could be used. Such a lid would drape over the top of the bag in use. Other types of suitable lids may also be used.

Other modifications and alterations may be used in the design and manufacture of the support rack of the present invention without departing from the spirit and scope of the accompanying claims.

What is claimed is:

1. A support rack for dual handled plastic bags for use in storing refuse, comprising:

a frame having a first horizontal portion in the upper region of said rack, a second horizontal portion in the lower region of said rack, and a vertical portion in the rear region of said rack;

said first horizontal portion comprising a front frame member, a side frame member, and a rear frame member, which together co-operate to form a bag support member;

said vertical portion comprising at least one generally vertical member and attachment means for permitting said frame to be attached to a vertical receiving surface, and with said vertical portion extending generally downwardly beneath said rear frame member of said first horizontal portion;

a first arm means and a second arm means, said first arm means attached to said front frame member of said first horizontal portion and said second arm means attached to said rear frame member of said first horizontal portion, said first and second arm means being adapted to receive and retain handles of a plastic bag, with said first arm means and said second arm means being displaced from each other such that a plastic bag having one handle on said first arm means and one handle on said second arm means would be held open and thereby be adapted to receive and retain refuse;

with each of said first and second arm means having a stop means connected thereto to preclude the handles of a bag in place on said arm means from being displaced strictly horizontally off said arm means;

said second arm means adapted to receive both handles of one or more bags and retain an inventory of bags thereon, with said bags draping downwardly therefrom;

said second horizontal portion extending outwardly from the lower area of said vertical portion of said rack, thus providing a support means for supporting the bottom area of a plastic bag when in place on said first and second arm means;

clip arm means for retaining the bottom portion of said inventory of bags when in place on said second arm means.

2. The support rack of claim 1, wherein said bag support member also has one open side for easy depositing and removal of plastic bags.

3. The support rack of claim 1, wherein said clip arm means comprises a pivotable arm located near the bottom of said rear frame member, with said clip arm means being urged rearwardly.

4. The support rack of claim 1, wherein said clip arm means comprises a pivotable arm located near the bottom of said rear frame member, with said clip arm means being urged rearwardly by spring means.

5. The support rack of claim 1, wherein said clip arm means comprises a stationary generally vertically displaced arm located near the bottom of said rear frame member.

6. The support rack of claim 1, wherein said second arm member is longer than said first arm member, such that a plurality of bags can be maintained in said inventory.

7. The support rack of claim 1, wherein said first stop means comprises an upwardly sloping arm.

8. The support rack of claim 1, wherein said second horizontal portion has an upturned lip at its outermost portion for precluding outward horizontal displacement past said lip of the bottom portion of said plastic bag when in place on said first and second arm means.

9. A support rack for dual handled plastic bags for use in storing refuse, comprising:

a frame having a first horizontal portion in the upper region of said rack, a second horizontal portion in the lower region of said rack, and a vertical portion in the rear region of said rack;

said first horizontal portion comprising a front frame member, a side frame member, and a rear frame member, which together co-operate to form a bag support member, with said bag support member having one open side for easy depositing and removal of plastic bags;

said vertical portion comprising a pair of generally vertical members and an attachment plate therebetween for permitting said frame to be attached to a vertical receiving surface, and with said vertical members extending generally downwardly beneath said rear member of said first horizontal portion and a connecting member located at the bottom of said pair of vertical members and spanning therebetween;

a first arm means and a second arm means, said first arm means attached to said front frame member of said first horizontal portion and said second arm means attached to said rear frame member of said first horizontal portion, said first and second arm means being adapted to receive and retain handles of a plastic bag, with said first arm means and said second arm means being displaced from each other such that a plastic bag having one handle on said first arm means and one handle on said second arm means would be held open and thereby be adapted to receive and retain refuse;

with each of said first and second arm means having a stop means connected thereto to preclude the handles of a bag in place on said arm means from being displaced strictly horizontally off said arm means;

said second arm means adapted to receive both handles of one or more bags and retain an inventory of bags thereon, with said bags draping downwardly therefrom;

said second horizontal portion extending outwardly from said connecting member of said vertical portion of said rack and comprising a front frame member and a plurality of connecting arms between said front frame member and said connecting member, thus providing a support means for supporting the bottom area of a plastic bag when in place on said first and second arm means;

clip arm means pivotable about said connecting member with said clip arm means being urged rearwardly by spring means for retaining the bottom portion of said inventory of bags.

10. The support rack of claim 9, wherein said second horizontal portion has an upturned lip at its outermost portion for precluding outward horizontal displacement past said lip of the bottom portion of said plastic bag when in when in place on said first and second arm means.

11. A support rack for dual handled plastic bags for use in storing refuse, comprising:

a frame having a first vertical portion in the front region of said rack, a second vertical portion in the rear region of said rack and a horizontal portion in the lower region of said rack;

said horizontal portion comprising at least one generally horizontal member connecting said first and second vertical portions, said second vertical portion comprising first and second generally horizontal members with said first generally horizontal member located in the upper region of said second vertical portion and said second generally horizontal member located in the lower region of said second vertical portion, and at least one generally vertical member spanning between said first and second generally horizontal members, and attachment means for permitting said frame to be attached to a substantially vertical receiving surface;

a first arm means and a second arm means, said first arm means attached to said front frame member of said first horizontal portion and said second arm means attached to said rear frame member of said first horizontal portion, said first and second arm means being adapted to receive and retain handles of a plastic bag, with said first arm means and said second arm means being displaced from each other such that a plastic bag having one handle on said first arm means and one handle on said second arm means would be held open and thereby be adapted to receive and retain refuse;

with each of said first and second arm means having a stop means connected thereto to preclude the handles of a bag in place on said arm means from being displaced strictly horizontally off said arm means;

said second arm means adapted to receive both handles of one or more bags and retain an inventory of bags thereon, with said bags draping downwardly therefrom;

said horizontal portion comprising at least one generally horizontal member connecting said first and second vertical portions, and providing a support means for supporting the bottom area of a plastic bag when in place on said first and second arm means;

clip arm means for retaining the bottom portion of said inventory of bags when in place on said second arm means.

* * * * *